US010538929B2

(12) United States Patent
Smith et al.

(10) Patent No.: US 10,538,929 B2
(45) Date of Patent: Jan. 21, 2020

(54) AUTOMATED SAFETY RAIL SYSTEM

(71) Applicants: Brent Edward Smith, Weston, MO (US); Matthew Scott Small, Olathe, KS (US); Travis Michael Budenbender, Lenexa, KS (US)

(72) Inventors: Brent Edward Smith, Weston, MO (US); Matthew Scott Small, Olathe, KS (US); Travis Michael Budenbender, Lenexa, KS (US)

(73) Assignee: Leading Edge Safety, LLC, Kansas City, MO (US)

( * ) Notice: Subject to any disclaimer, the term of this patent is extended or adjusted under 35 U.S.C. 154(b) by 387 days.

(21) Appl. No.: 15/459,148

(22) Filed: Mar. 15, 2017

(65) Prior Publication Data

US 2018/0266127 A1 Sep. 20, 2018

(51) Int. Cl.
*E04G 21/32* (2006.01)

(52) U.S. Cl.
CPC ..... *E04G 21/3228* (2013.01); *E04G 21/3223* (2013.01); *E04G 21/3233* (2013.01); *E04G 21/3238* (2013.01)

(58) Field of Classification Search
USPC ..... 340/500
See application file for complete search history.

(56) References Cited

U.S. PATENT DOCUMENTS

| | | | | |
|---|---|---|---|---|
| 4,909,483 | A * | 3/1990 | van Herpen | E04G 21/3233 256/59 |
| 2008/0296922 | A1* | 12/2008 | Diamond | B60P 3/34 296/26.13 |
| 2014/0367628 | A1* | 12/2014 | Hewson | E04G 21/3242 256/65.14 |
| 2015/0023774 | A1* | 1/2015 | Seto | E04G 21/3228 414/800 |
| 2018/0258656 | A1* | 9/2018 | Smith | E04F 11/1865 |

* cited by examiner

*Primary Examiner* — Brent Swarthout
(74) *Attorney, Agent, or Firm* — Mashburn Law Office, LLC; Donna Denise Mashburn Chapman

(57) ABSTRACT

An automated safety rail system for use on an elevated surface or for temporarily blocking off a restricted area, the automated safety rail system broadly includes primary support structures, horizontally extending support structures, an actuator for shifting the support structures between a disengaged and an engaged configuration, and an electronic control system.

18 Claims, 5 Drawing Sheets

AUTOMATED SAFETY RAIL SYSTEM

BACKGROUND

Embodiments of the present invention generally relate to safety rail systems.

Safety rail systems are used to prevent workers or other people from falling off of elevated surfaces or to prevent people from entering dangerous or restricted areas. Conventional safety rail systems may be permanent or temporary. Permanent rail systems are installed on site and are typically integrally mounted or constructed to the surface or area to be protected, which presents a number of drawbacks. For example, these rail systems must be designed and specified by a safety expert and a structural expert, who must coordinate with the building's architect for aesthetic considerations. This tremendously increases the building cost. Permanent railing systems also cannot be removed, which may reduce the building's aesthetic appeal. Temporary railing systems may be used instead of permanent rail systems, but they have drawbacks as well. For example, temporary rail systems must be installed before the protected area can be used or worked on. This is time consuming and costly. In addition, the workers installing the temporary railing system either do not have fall protection or must use alternative fall protection, which further increases time and cost. Also, temporary railing systems may be installed incorrectly by unskilled non-safety oriented workers.

SUMMARY

An automated safety rail system for use on an elevated surface or for temporarily blocking off a restricted area and constructed in accordance with embodiments of the invention is illustrated. The automated safety rail system broadly comprises a set of modular sections each including one or more primary support rails, a set of horizontal rails connected to the primary support rails, an actuator attached to one of the primary support structures for shifting the primary support rails and the horizontal rails between a disengaged and an engaged configuration, and a locking mechanism for securing the primary support rails and the horizontal rails in the engaged configuration. The automated safety rail system may also include an electronic control system for remotely activating the actuators and the locking mechanism.

Another embodiment of the invention is a method of controlling an automated safety rail system. The electronic control system activates a first set of pneumatic valves to send pressurized air to the actuators and then activates a second set of pneumatic valves to send pressurized air to the locking mechanisms.

This summary is provided to introduce a selection of concepts in a simplified form that are further described in the detailed description below. The summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
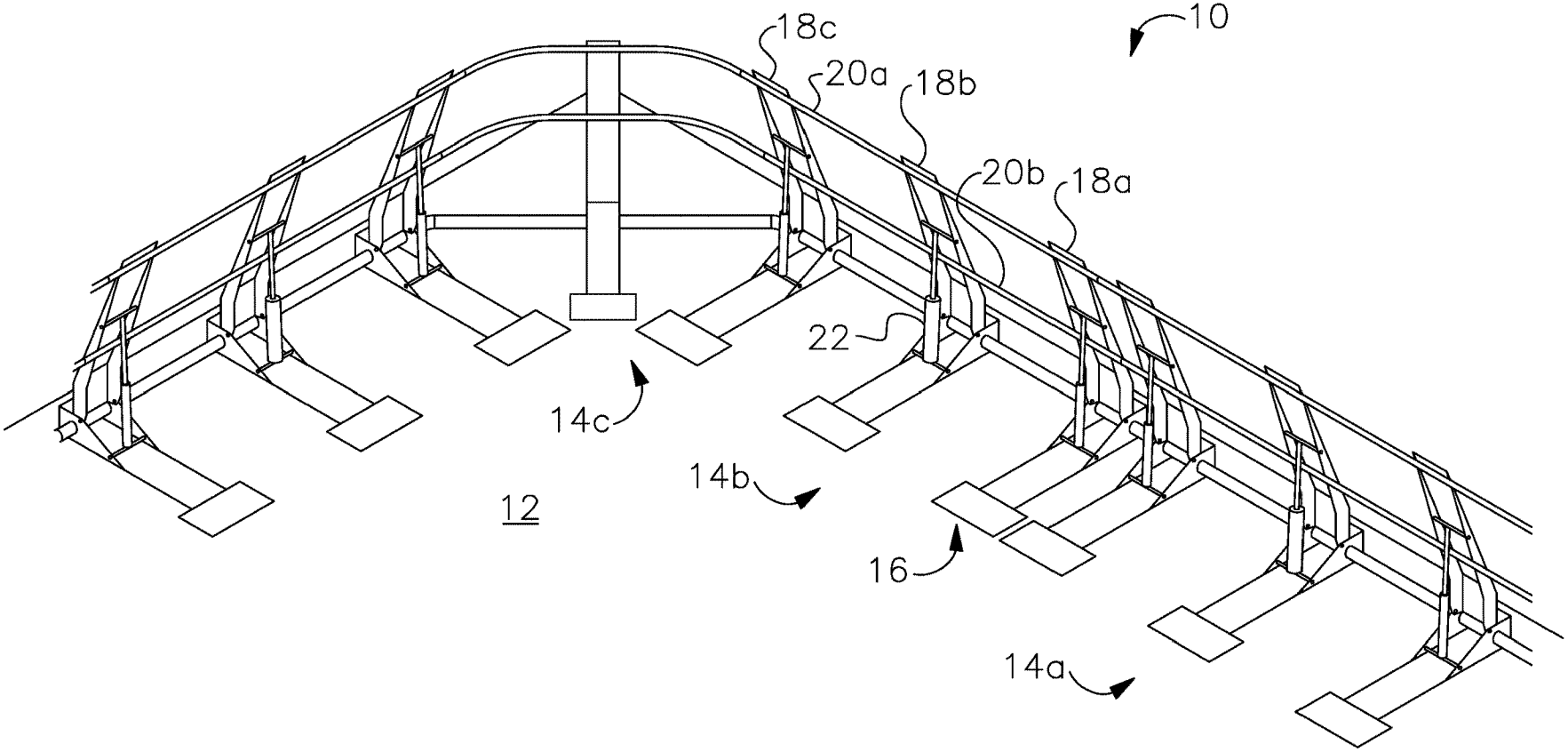
FIG. 1 is a perspective view of an automated safety rail system constructed in accordance with an embodiment of the invention.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Figure 4:
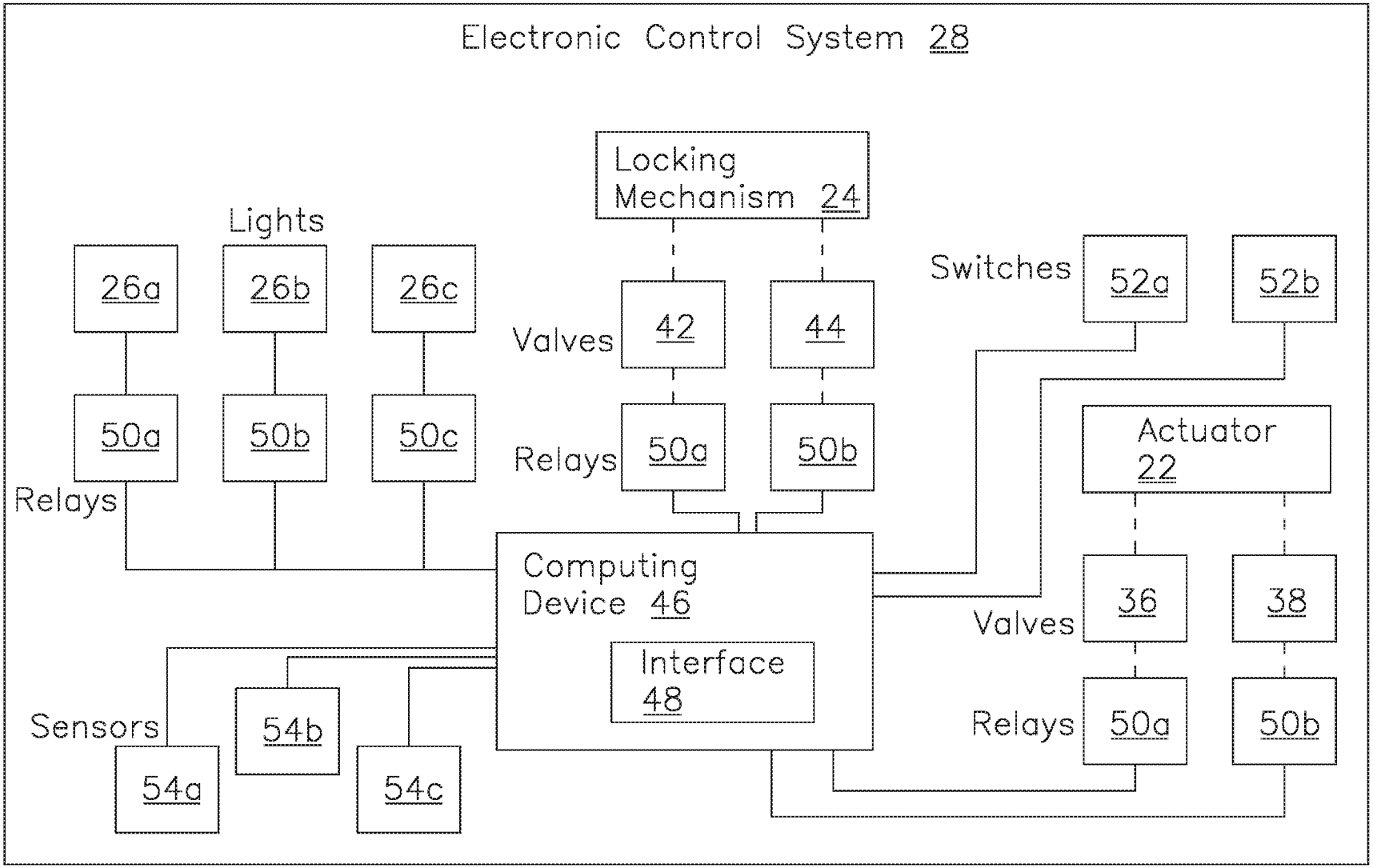
FIG. 4 is a schematic of an electronic control system of the automated safety rail system of FIG. 1.
Figure 5:
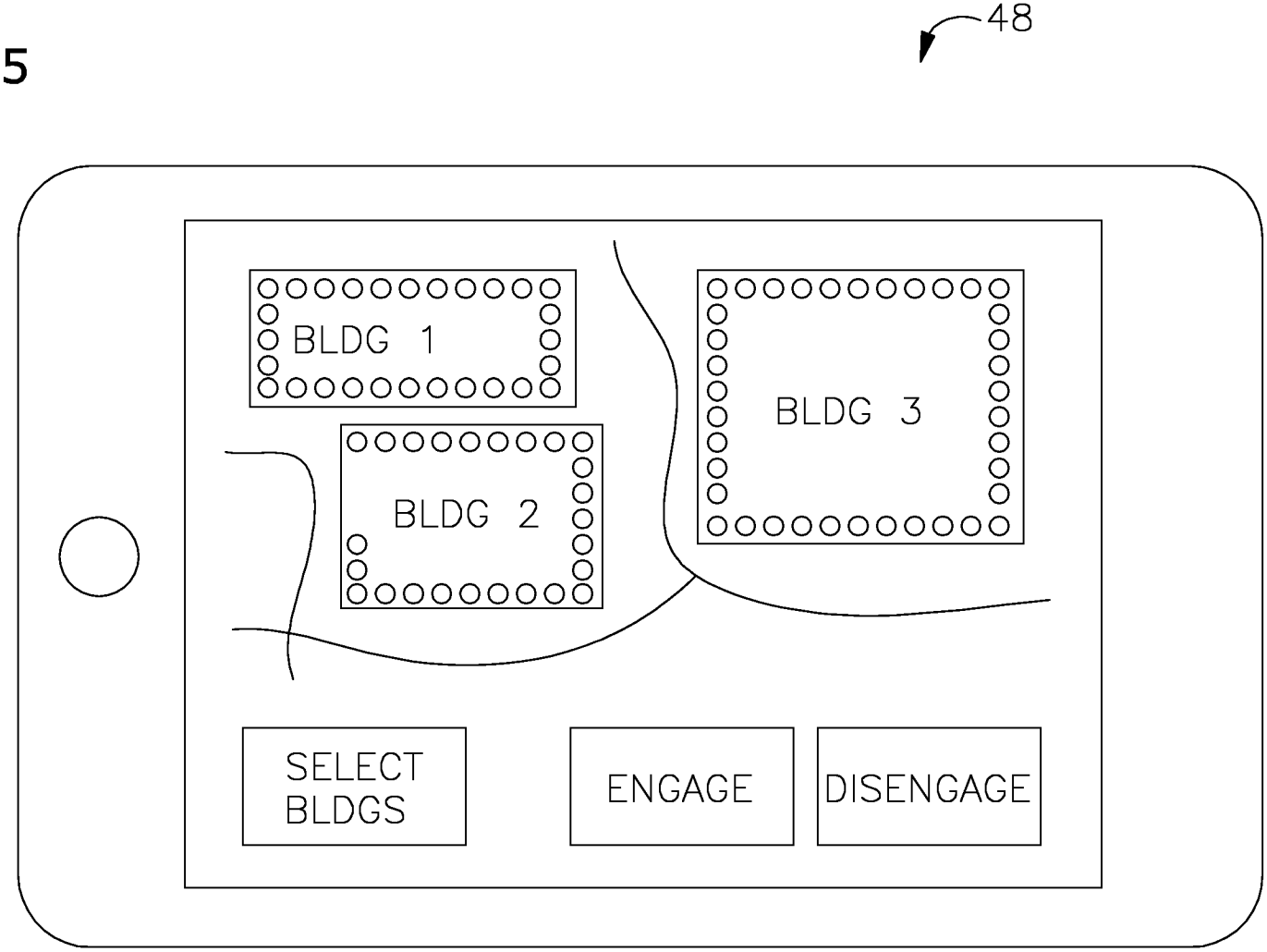
FIG. 5 is a user interface of the electronic control system of FIG. 4.

Turning now to the drawing figures, and particularly FIGS. 1-5, an automated safety rail system 10 for use on an elevated surface 12 or for temporarily blocking off a restricted area is illustrated. The safety rail system 10 broadly comprises one or more sections 14*a-c* each including a skid 16, one or more primary support structures 18*a-c* spaced from each other and supported on the skid 16, a plurality of substantially horizontally extending members 20*a,b* connected between the primary support structures 18*a-c*, an actuator 22 attached to one of the primary support structures 18*a-c* and configured to shift the primary support structures 18*a-c* and the horizontally extending members 20*a,b* between an engaged configuration (FIG. 2) and a disengaged configuration (FIG. 3), and a locking mechanism 24 configured to lock the primary support structures 18*a-c* and the horizontally extending members 20*a,b* in the engaged configuration. The safety rail system 10 may also include a plurality of lights 26*a-c* for indicating a status of the safety rail system 10 and an electronic control system 28 configured to remotely activate the safety rail system 10 (FIG. 4).

Turning again to FIG. 2, the skid 16 is configured to support the section 14*a* on the elevated surface 12 or at a designated location. The skid 16 may include a set of weights 30*a-c* or anchors for preventing the section 14*a* from being slid or overturned. The weights 30*a-c* may be removable or filled with fluid and drainable for dismantling and installing the safety rail system 10. The skid 16 may be partially structurally constructed of a pneumatic conduit 32 such as a steel pipe with connectors on either end for transferring pressurized air to the actuator 22.

Figure 2:
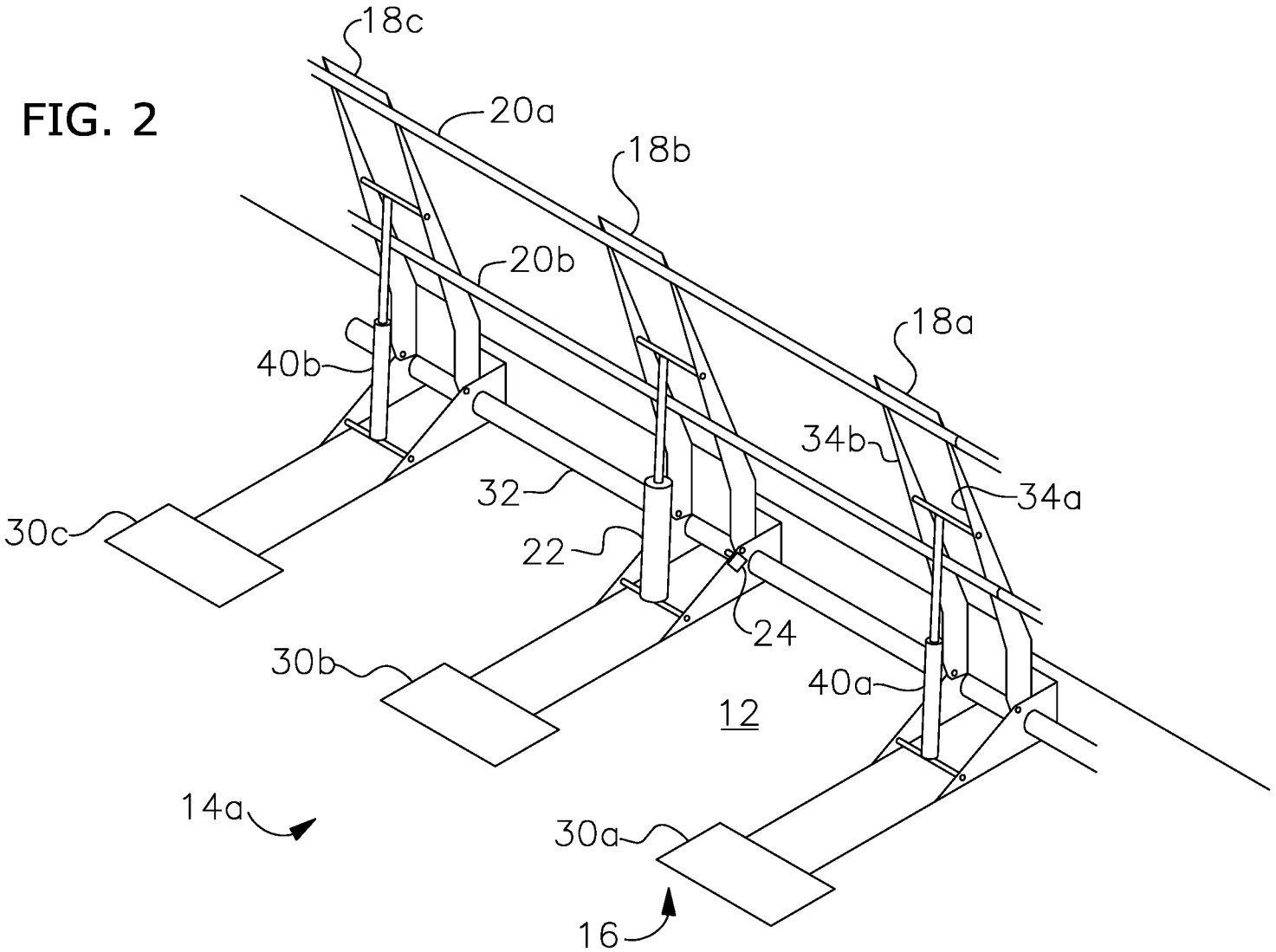
FIG. 2 is a perspective view of a section of the automated safety rail system of FIG. 1 in an engaged configuration.
Figure 3:
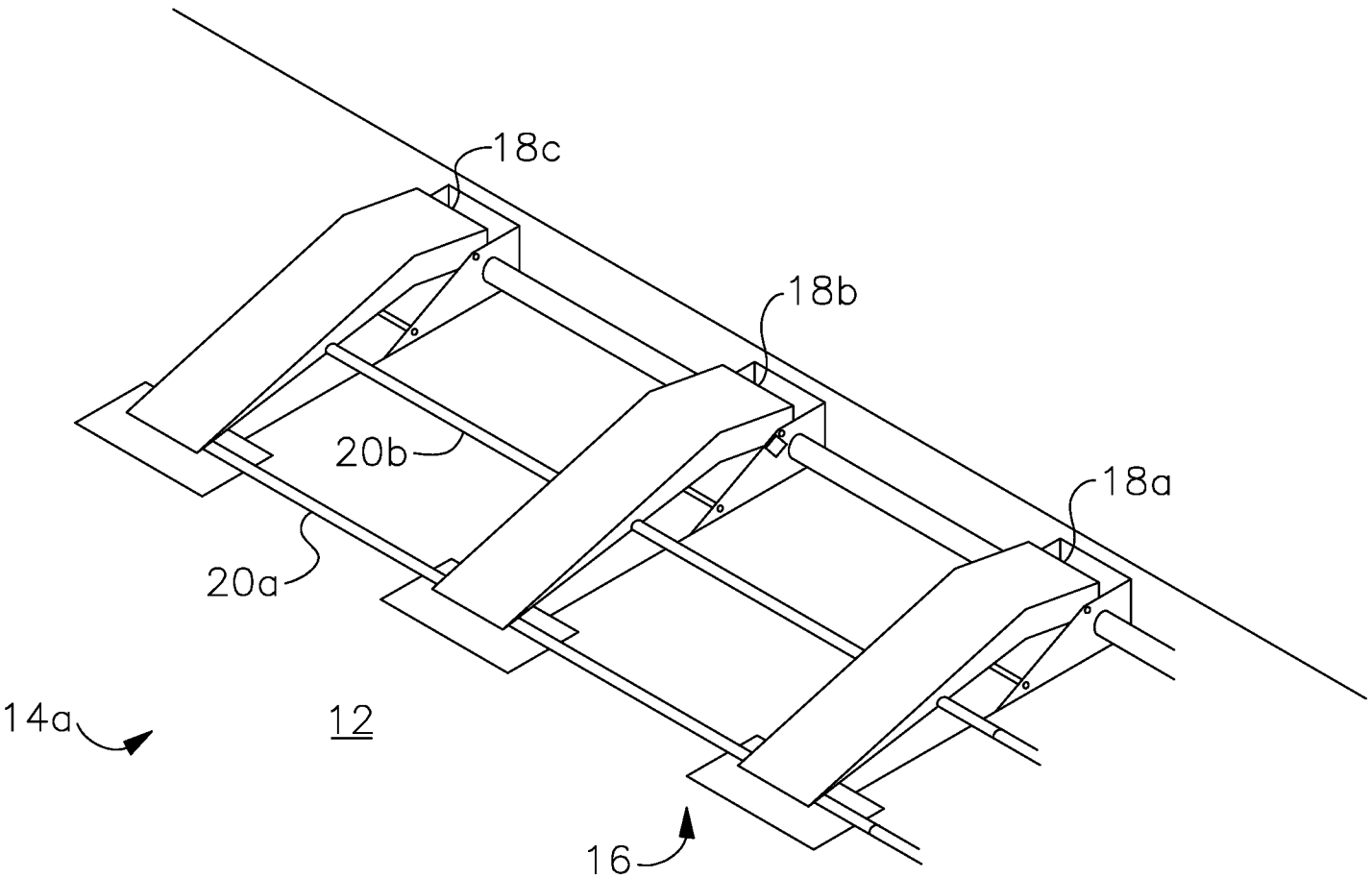
FIG. 3 is a perspective view of the section in FIG. 2 in a disengaged configuration.

The primary support structures 18*a-c* are provided for supporting the horizontally extending members 20*a,b* and for bearing horizontal and vertical forces to prevent a person from falling off of the elevated surface 12 or to prevent the person from passing into the restricted area. Because the primary support structures 18*a-c* are essentially identical, only primary support structure 18*a* will be described. The primary support structure 18*a* may be cylindrical or another elongated structural member and is formed of a strong material such as steel, aluminum, or titanium. The primary support structure 18*a* may also be an elongated plate with perpendicular or angled slats 34*a,b* for providing strength, as shown in FIG. 2. The primary support structure 18*a* may also have a curvature or bend along its length for providing additional strength. The primary support structure 18*a* may be shaped to cover or protect the actuator 22 or other components when in the disengaged configuration.

The horizontally extending members 20*a,b* are provided for preventing a person from falling off of the elevated surface 12. The horizontally extending members 20*a,b* may be rails, cables, chains, beams, or other structural members for bearing horizontal and vertical forces to prevent a person from falling off of the elevated surface 12 or to prevent the person from passing into the restricted area. The horizontally extending members 20*a,b* may be formed of a strong material such as steel, aluminum, titanium, or wood. Some of the horizontally extending members 20*a,b* are mounted between tops of the primary support structures 18*a-c* (i.e., toprails) and some are mounted between midportions of the primary support structures (i.e., midrails). Some of the horizontally extending members 20*a,b* may include bends or curves along their lengths for use on corner sections or angled sections of the safety rail system 10, as described below. The horizontally extending members 20*a,b* may be connectable to adjacent horizontal rails via a fastener, clamp, or other component.

The actuator 22 is configured to shift the primary support structures 18*a-c* and the horizontally extending members 20*a,b* from the disengaged configuration to the engaged configuration when pressurized air is supplied to it and from the engaged configuration to the disengaged configuration when pressurized air is released from it. The actuator 22 is attached to the middle primary support structure 18*a* for providing a balanced lifting force to the primary support structures 18*a-c*. The actuator 22 may be pneumatic, hydraulic, electrical, or magnetic. Additional actuators may be used if one actuator 22 does not provide sufficient lifting force. The actuator 22 is connected to a valve 36 via a pneumatic line that is configured to be activated to allow pressurized air to be supplied to the actuator 22 for engaging the safety rail system 10. The actuator 22 may be connected to another valve 38 that is configured to be activated to release the pressurized air for disengaging the primary support structures 18*a-c* and the horizontally extending members 20*a,b*. Alternatively, the actuator 22 may receive positive air pressure for both actively engaging and disengaging the primary support structures 18*a-c* and the horizontally extending members 20*a,b*. The actuator 22 may be continually pressurized as long as the section 14*a* is engaged. Additional valves and pneumatic lines may be used to sectionalize the safety rail system for complete control of the safety rail system. For example, if only a portion of the elevated surface will be accessed, the additional valves can be activated to only engage a portion of the safety rail system 10. As another example, if one section does not engage properly, air can be rerouted to the remaining sections by switching the additional valves so that as many sections can be engaged as possible. This allows for maximum safety while the non-engaging section is repaired.

Dampers 40*a,b* may be attached to the primary support structures 18*a-c* for limiting a speed at which the actuator 22 shifts the primary support structures 18*a-c* and the horizontally extending members 20*a,b* between the disengaged configuration and the engaged configuration.

The locking mechanism 24 is configured to secure the primary support structures 18*a-c* and the horizontally extending members 20*a,b* in the engaged configuration when pressurized air is supplied to it. The locking mechanism 24 may also provide additional support to the primary support structures 18*a-c* for withstanding forces. The locking mechanism 24 may be pneumatic, hydraulic, electrical, or magnetic. The locking mechanism 24 may receive positive air pressure for both actively locking and unlocking or may be passively unlocked by releasing the air pressure. The locking mechanism 24 may have a spring, a magnet, or other biasing mechanism for shifting the lock when air pressure is removed. Additional locking mechanisms may be used on each section 14*a* if one locking mechanism 24 does not sufficiently secure the primary support structures 18*a-c* in the engaged configuration. The locking mechanism 24 is connected to a valve 44 that is configured to be activated to allow pressurized air to be supplied to the locking mechanism 24. The locking mechanism 24 may be connected to another valve 46 that is configured to be activated to release the pressurized air.

The lights 26*a-c* (FIG. 4) are positioned on the primary support structures 18*a-c* or anywhere that is easily visible to someone on the elevated surface 12. The lights 26*a-c* are configured to illuminate different colors or patterns to indicate a status of the safety rail system 10. For example, the lights 26*a-c* may illuminate red when the safety rail system 10 is in the disengaged configuration, to indicate that the elevated surface 12 is not safe. The lights 26*a-c* may illuminate yellow or a blinking yellow to indicate that the safety rail system 10 is being shifted between the disengaged configuration and the engaged configuration. The lights 26*a-c* may illuminate green when the safety rail system 10 is in the engaged configuration to indicate that the elevated surface 12 is safe.

The electronic control system 28 (FIG. 4) is provided to control the safety rail system 10 from any location such as a room in the building that includes the elevated surface 12, a centralized location for controlling safety rail systems on multiple buildings, or on a portable device. The electronic control system 28 is configured to selectively activate the actuator 22 and the locking mechanism 24. The electronic control system 28 may also be used to control different sections 14*a-c* of the safety rail system 10 separately or independently of each other.

The electronic control system 28 broadly includes a computing device 46 for controlling the safety rail system 10 and a user interface 48 for communicating with an operator. The electronic control system 28 may also include a plurality of relays 50*a-c* for supplying power or signals to the lights 26*a-c* and the valves 36, 38, 42, 44 and a plurality of limit switches 52*a,b* and a plurality of sensors 54*a-c* for sensing conditions of the safety rail system 10.

The computing device 46 may include or may be configured to access one or more computer programs stored in or on non-transient computer-readable medium. The computer programs may comprise listings of executable instructions for implementing logical functions in the computers and can be embodied in any non-transitory computer-readable medium for use by or in connection with an instruction execution system, apparatus, or device, such as a computer-based system, processor-containing system, or other system that can fetch the instructions from the instruction execution system, apparatus, or device, and execute the instructions. In the context of this application, a "computer-readable medium" can be any non-transitory means that can contain, store, or communicate the programs. The computer-readable medium can be, for example, but not limited to, an electronic, magnetic, optical, electro-magnetic, infrared, or semi-conductor system, apparatus, or device. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM). The computing device 46 may be a desktop computer, a server, a laptop computer, a tablet, a smartphone, a remote control, or other mobile or portable device, a GPS device, a mobile station in a rollable cabinet, or any other electronic device.

The computing device 46 receives data signals from the switches 52 and the sensors 54*a-c* and inputs from the user interface 48 to engage, disengage, or stop the safety rail system 10. The computing device 46 may also determine if any control or actuation component of the safety rail system 10 needs to be replaced or fixed based on data received from the sensors 54*a-c*. The computing device may also manage and store data generated by the operation of the safety rail system 10. For example, time stamps corresponding to the time period that the safety rail system 10 is engaged may be recorded for later showing that the safety rail system 10 was in fact engaged at a particular time of interest. Similarly, worker start and end times may be stored. Safety rail system inspection information such as inspector names, times of inspection, inspection scope, and relevant notes may be stored as well for future reference. Information corresponding to work performed on the elevated surface 12 such as worker name, task completed, start time and end time on the elevated surface 12, materials used, and any related issue may also be documented in the computing device 46.

The computing device 46 receives inputs from the user interface 48 such as commands to engage or disengage the safety rail system 10. The computing device 46 then controls the valves 36, 38, 42, 44 accordingly. The computing device receives data in the form of signals from the sensors 54*a-c* that assist the computing device 46 in controlling the safety rail system 10. For example, if the sensors 54*a-c* sense an obstruction that prevents the safety rail system 10 from engaging or disengaging normally, the computing device controls the valves 36, 38 to stop the safety rail system 10 from engaging. The computing device also sends outputs such as virtual images to the user interface 48 representing the information received from the sensors 54*a-c*. The computing device 46 may also determine possible actions and options for the operator to choose (or to be executed automatically) if the safety rail system 10 does not engage or disengage normally so that maximum safety is employed. The computing device 46 may also store any of this information for troubleshooting or for later reference.

The user interface 48 (FIG. 5) may include a touch screen, a monitor and input device, a control panel, or any other device which a user may perceive instructions and system statuses and may input commands or data into the computing device 46 for controlling the safety rail system 10. The user interface 48 includes buttons and controls (real or virtual) for commanding the control system 28 to engage or disengage the safety rail system 10. The user interface 48 may display lights or images corresponding to the status of the safety rail system 10. For example, the user interface 48 may display a red image indicating that the safety rail system 10 is in the disengaged configuration, a yellow image indicating that the safety rail system 10 is shifting between the disengaged and the engaged configuration, and a green image indicating that the safety rail system 10 is in the engaged configuration. The user interface 48 may display a virtual layout or a virtual array of the sections 14*a-c* or components of the safety rail system 10. The user interface 48 may indicate which section or components are actuated, activated, engaged, disengaged, locked, unlocked, or in need of repair or maintenance. The user interface 48 may also indicate where an obstruction is sensed and may provide options to the operator to choose how to proceed. The user interface 48 may also indicate that an elevated surface 12 is safe (i.e., that the safety rail system 10 is in the engaged configuration around the entire elevated surface 12). The user interface 48 may also display a virtual layout or a virtual array of buildings or areas that have safety rail systems installed for complete control and supervision of an entire campus or premise.

The user interface 48 may include virtual input boxes for inputting inspection information, as described above. It will be appreciated that the user interface 48 for this purpose may be part of a mobile device separate of a central user interface, which an onsite worker may use on the elevated surface 12 when inspecting the safety rail system 10 or working on the elevated surface 12.

Turning again to FIG. 4, the relays 50*a-c* or other electronic circuit components are provided for selectively providing power or electronic signals to the lights 26*a-c* and for creating lighting patterns such as blinking and pulsing and/or for selectively activating the valves 36, 38, 42, 44 for engaging and disengaging the safety rail system 10. The limit switches 52*a,b* are provided for sensing that the primary support structures 18*a-c* and the horizontally extending members 20*a,b* are in the engaged or the disengaged configuration. The limit switches 52*a,b* open or close a circuit when the structures 18*a-c* or members 20*a,b* reach a predetermined point, which signifies that they have reached the desired configuration.

The sensors 54*a-c* are provided for sensing a number of conditions of the safety rail system 10. The sensors 54*a-c* may include air pressure sensors, pressure sensors, light sensors, motion sensors, etc. For example, the sensors 54*a-c* may sense the amount of air pressure at any point in the safety rail system 10 for determining whether the safety rail system 10 is engaged, disengaged, or being actuated, or for sensing air leaks. The sensors 54*a-c* may preemptively sense that an obstruction such as a worker is in the way of the safety rail system 10 so that the control system 28 may stop the safety rail system 10 from shifting. The sensors 54*a-c* may also sense that the safety rail system 10 has encountered an obstruction by sensing an impact or by sensing a rise in backpressure. The sensors 54*a-c* may be positioned one of each type of sensor on each section 14*a* or component for making determinations for each section 14*a* or component separately. This allows complete information and control of the safety rail system 10, as described above.

Although the invention has been described with reference to the embodiments illustrated in the attached drawing figures, it is noted that equivalents may be employed and substitutions made herein without departing from the scope of the invention as recited in the claims. Having thus described various embodiments of the invention, what is claimed as new and desired to be protected by Letters Patent includes the following:

The invention claimed is:

1. A safety rail system for use on an elevated surface, the safety rail system comprising:

a plurality of primary support structures spaced from each other;

a plurality of substantially horizontally extending members connected between the primary support structures;

an actuator configured to shift the primary support structures and the substantially horizontally extending members between a disengaged configuration and an engaged configuration;

a plurality of skids each having a conduit section connectable to conduit sections of adjacent skids, the conduit sections collectively being configured to carry pressured air to an actuator of each skid; and a locking mechanism configured to lock the primary support structures and the horizontally extending members in the engaged configuration, wherein the primary support structures are substantially vertical in the engaged configuration such that the primary support structures and the horizontally extending members are configured to prevent a person from falling off of the elevated surface.

2. The safety rail system of claim 1, further comprising a locking mechanism configured to lock the primary support structures and the horizontally extending members in the engaged configuration.

3. The safety rail system of claim 2, further comprising an electronic control system for selectively activating the actuator and the locking mechanism.

4. The safety rail system of claim 1, further comprising a plurality of lights mounted on the safety rail system, the lights configured to display different colors for indicating to a person near the safety rail system whether the primary support structures and the substantially horizontally extending members are in the disengaged configuration, are in the engaged configuration, or are being shifted between the disengaged configuration and the engaged configuration.

5. The safety rail system of claim 1, wherein each skid includes three of the primary support structures and at least one damper connected to one of the primary support structures, the actuator being connected to the middle of the three primary support structures for applying a balanced actuating force to the primary support structures.

6. The safety rail system of claim 1, further comprising a valve connected to each actuator for selectively applying pressurized air to the respective actuator.

7. The safety rail system of claim 6, further comprising a locking mechanism configured to lock the primary support structures and the horizontally extending members in the engaged configuration and a valve connected to each locking mechanism, wherein the valves connected to the actuators are configured to be activated in a sequence starting with a valve of a skid at a first end of a line of skids and ending with a valve at a second end of the line of skids, and the valves connected to the locking mechanisms are configured to be activated in a sequence starting with a valve of at the second end of the line of skids and ending with a valve at the first end of the line of skids.

8. The safety rail system of claim 1, further comprising a corner skid including a single primary support structure, wherein substantially horizontal members connected to the primary support structure of the corner skid each include at least one bend for aligning with substantially horizontal members of adjacent skids.

9. The safety rail system of claim 5, wherein the primary support structures are formed of metal plates configured to cover the respective actuator or damper when the primary support structures are in the disengaged configuration for protecting the actuator or damper.

10. The safety rail system of claim 9, wherein the metal plates include perpendicular slats for providing structural support to the primary support structures.

11. A safety rail system comprising:

a plurality of skids connectable to each other, each skid including:

three primary support structures spaced from each other;

a plurality of substantially horizontally extending members connected between the primary support structures;

an actuator configured to shift the primary support structures and the substantially horizontally extending members between a disengaged configuration and an engaged configuration;

a locking mechanism configured to lock the primary support structures and the horizontally extending members in the engaged configuration;

a valve attached to the actuator and configured to selectively apply pressurized air to the actuator; and a valve attached to the locking mechanism and configured to selectively apply pressurized air to the actuator, and an electronic control system for selectively activating the actuators and the locking mechanisms via the respective valves, wherein the primary support structures are substantially vertical in the engaged configuration such that the primary support structures and the horizontally extending members are configured to prevent a person from falling off of an elevated surface or from entering an unauthorized area.

12. An electronic control system for controlling a safety rail system, the electronic control system comprising:

a user interface configured to display to an operator indicators representing whether the safety rail system is in the disengaged configuration, in the engaged configuration, or is being shifted between the disengaged configuration and the engaged configuration; and a plurality of electronic switches for selectively opening actuator valves for shifting the safety rail system between a disengaged configuration and an engaged configuration and a plurality of locking mechanism valves for activating the locking mechanisms when the electronic control system is shifted to the engaged configuration, wherein the safety rail system is configured to prevent a person from falling off of an elevated surface when in the engaged configuration.

13. The electronic control system of claim 12, further comprising a plurality of relays configured to selectively illuminate a plurality of lights on the safety rail system for indicating to a person on the elevated surface whether the safety rail system is in the disengaged configuration, in the engaged configuration, or is being shifted between the disengaged configuration and the engaged configuration.

14. The electronic control system of claim 13, wherein the lights are configured to illuminate red when the safety rail system is in the disengaged configuration, green when the safety rail system is in the engaged configuration, and yellow when the safety rail system is being shifted between the disengaged configuration and the engaged configuration.

15. The electronic control system of claim 12, wherein the user interface is further configured to display to an operator an indicator representing that the safety rail system is not operating properly.

16. The electronic control system of claim 15, wherein the safety rail system includes a plurality of sections and wherein the electronic control system includes a sensor on each section of the safety rail system for sensing a malfunction on the respective section and the user interface is configured to display to the operator an indication representing which section is malfunctioning.

17. The electronic control system of claim 11, further comprising a sensor configured to sense an obstruction preventing the safety rail system from being shifted normally from the disengaged configuration to the engaged configuration, wherein the electronic control system is configured to stop the safety rail system from shifting when an obstruction is sensed by the sensor.

18. The electronic control system of claim 17, wherein the user interface is configured to display to an operator an indicator representing that the sensor has sensed an obstruction.

* * * * *